United States Patent [19]

Wendell

[11] 4,169,753

[45] Oct. 2, 1979

[54] METHOD FOR AUTOMATIC SHIRT COLLAR STAY APPLYING

[76] Inventor: David Wendell, 8803 Kelso Dr., Baltimore, Md. 21221

[21] Appl. No.: 866,698

[22] Filed: Jan. 3, 1978

Related U.S. Application Data

[62] Division of Ser. No. 795,981, May 11, 1977, Pat. No. 4,109,810.

[51] Int. Cl.[2] ..... A41B 3/06; B32B 31/04; B32B 31/26

[52] U.S. Cl. ..... 156/160; 2/256; 2/258; 2/260.1; 156/293; 156/332; 156/494; 223/4

[58] Field of Search ..... 156/293, 303.1, 332, 156/163, 160, 300, 494; 223/2, 4; 112/121.12, 155; 2/256, 258, 260, 260.1

[56] References Cited

U.S. PATENT DOCUMENTS

| | | | |
|---|---|---|---|
| 713,247 | 11/1902 | Shepherd | 223/4 |
| 2,708,650 | 5/1955 | Pullman et al. | 156/332 |
| 2,849,719 | 9/1958 | Loew | 2/258 |
| 2,875,928 | 3/1959 | Cohen | 223/2 |
| 2,884,640 | 5/1959 | Liebowitz | 2/258 |
| 3,191,557 | 6/1965 | Moore | 223/2 |
| 3,686,692 | 8/1972 | Snare et al. | 2/258 |
| 4,026,749 | 5/1977 | Appelhans et al. | 156/252 |

*Primary Examiner*—Jerome W. Massie
*Attorney, Agent, or Firm*—Horace S. Harper

[57] ABSTRACT

The method of stiffening the ends for shirt collars or the liner therefore is achieved by first forming an elongated polyester stiffening element or stay to be attached to the collar or collar liner. At least one side of the stay is coated with a polyester heat fusible film. The stay is placed within the ends of the collar with the polyester film placed adjacent the material to which the stay is to be at least temporarily attached after which heat is applied at a pre-determined temperature and for a pre-determined period, preferably by an electric heating element to the area adjacent the stay thereby softening the polyester film carried by the stay to a point of causing the polyester film to soften and adhere to the adjacent material. The method is carried out preferably by a semi-automatic machine shown and described herein. The stays are placed in a stack at each side of the machine from which a single stay is removed and placed in each end of the collar or liner as the case may be. The machine is provided with a thin shelf at each side of the machine of substantially the same configuration as the collar ends over which the ends of a collar or liner are drawn by a machine element until the outer ends of the collar or collar liner are substantially in contact with the outer edges of the shelf where automatic heating elements are applied to the area of the stay for applying the stay to the collar or lining.

3 Claims, 8 Drawing Figures

86
72
71
73
74
56
54
52
44
43'
43
70
58
64
42
14
60
62
40
50
30a
12
68
66
48
12'
10
76
75
18
H
78
77
80

METHOD FOR AUTOMATIC SHIRT COLLAR STAY APPLYING

This is a division of application Ser. No. 795,981, filed May 11, 1977, now U.S. Pat. No. 4,109,810.

The invention relates to a method of attaching stiffening elements or stays to a shirt collar or collar lining.

The primary object of the invention is to provide a method of applying a stiffening element in the form of an elongated flexible polyester stiffening stay in which the polyester stiffening stay is provided with a coating of heat sensitive polyester film on at least one side of the stay having a lower softening point than the polyester stay.

A further object of the invention is to provide an apparatus or machine for applying the polyester coated stays to the collar or collar linings.

A further object of the invention is to provide a machine that will greatly reduce the time of applying these stiffening elements or stays to the shirt collar or lining therefor.

While several objects of the invention have been set forth other object uses and advantages will become apparent as the nature of the invention is further disclosed in the detailed description of the method and a machine for applying the stays to follow with reference to the accompanying drawings, in which.

In referring to the detailed description like and similar reference characters are used to indicate like and similar parts throughout the several views and the term apparatus is interchangeable with the term machine.

The principal of applying the stays in each end of the collar and/or the collar liner is substantially the same, and any reference to the collar or collar liners is intended to include the other.

The complete machine is referred to by the numeral 10, which comprises preferably a table-like supporting structure on which is supported a pair of horizontal collar supporting plate members 30A and 30B.

The collar stiffening means per se is in the form of thin elongated strip members 14 as shown best in FIG. 1, and which may later be referred to as a stay. These stay members are provided on at least one side thereof with a thin coating of heat sensitive adhesive, preferably in the form of a polyester film 18. The side of the stay carrying the polyester film 18 is placed adjacent the collar material or the liner 12 to which it is to be attached after which heat is applied to the area of the stay for causing the adhesive to soften and adhere to the collar or liner material. It is possible that under certain types of construction both sides of the stay may carry the heat sensitive adhesive.

Figure 2:
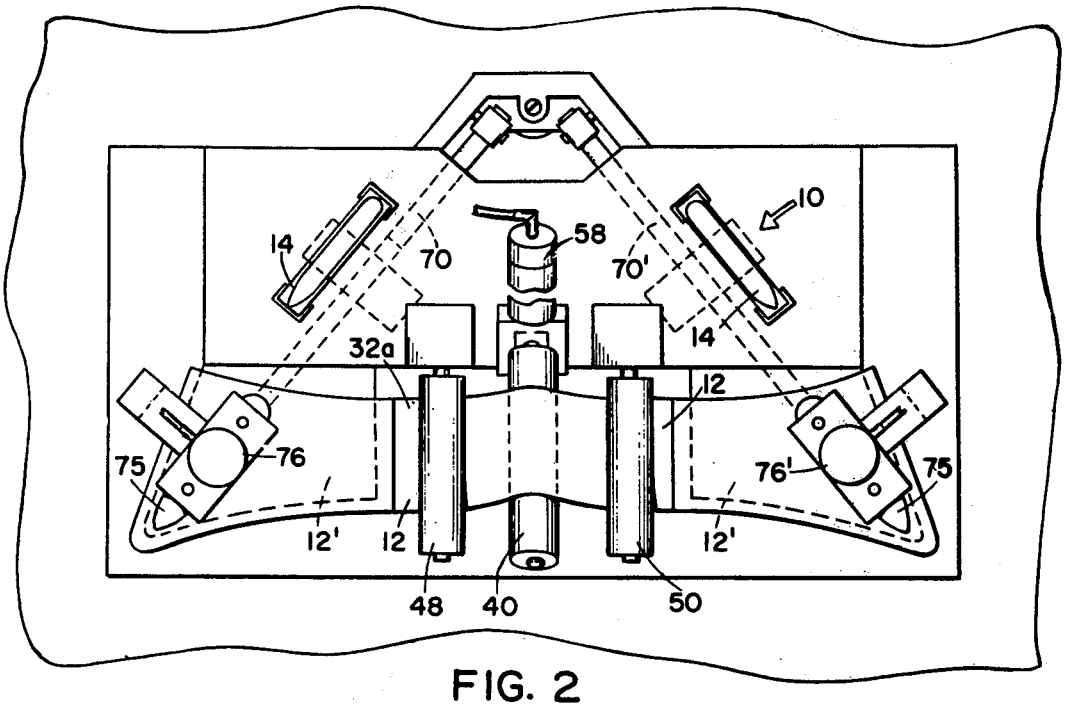
FIG. 2 is a top plan view of the apparatus.
Figure 3:
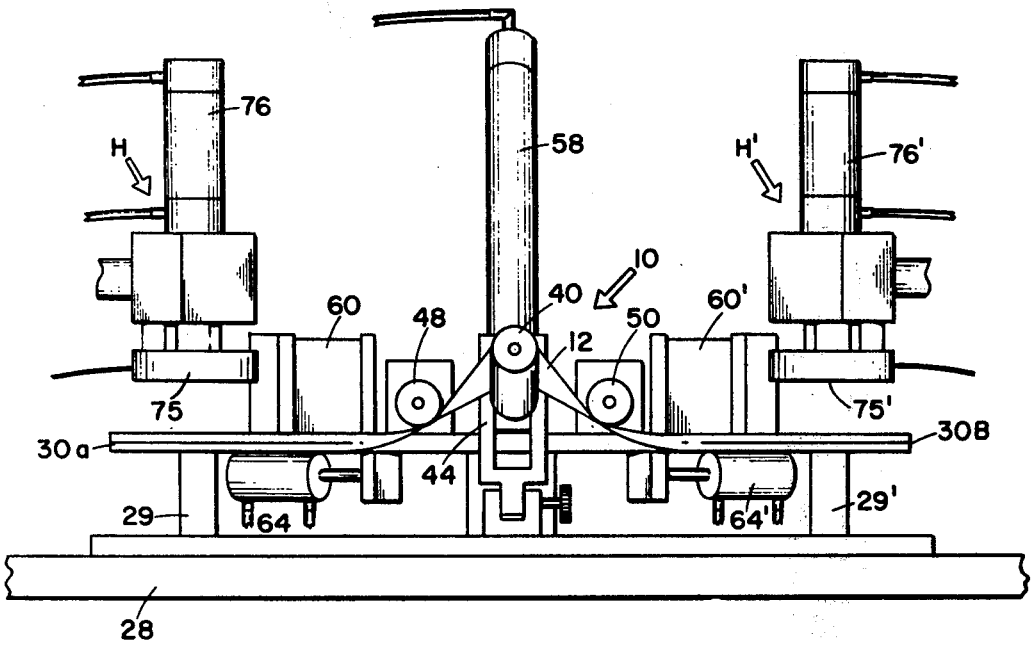
FIG. 3 is an elevational view of the same.

The collar liner 12 and 12' is used to give the finished shirt collar a stiffened effect and is generally formed from a semi-stiff material such as buckram, but is not limited thereto. The machine is designed for duplicate operation, that is, it places a stiffening stay at each end of the collar, or liner simultaneously, as shown in FIG. 2.

The plate members 30A and 30B are supported above table top 28 on spacers 29 and 29' and are of substantially thin construction which are adapted to receive the ends of the collar or collar liners. In the drawings the liners are shown in double thickness adjacent the ends of the collar which provides the end of the liner with a pocket into which the stay is inserted. These pockets are constructed before they are placed into the machine and the plates 30A and 30B are inserted into these pockets and drawn in close contact with the plates 30A and 30B by a tightening roll 40.

The tightening roll 40 is mounted for vertical adjustment centrally of the machine and is supported upon a substantially horizontal axle 42 which is, in turn, supported at one end by a member 52 slidably supported in a bifurcated member 44. The roller 40 is free floating and may be tilted from its horizontal plane by moving the linkage either forward or backward relative to the machine as indicated by the arrows 43 and 43'. The member 52 is provided with a stem 54 which in turn is connected to the upper end of a compressible spring. The block is forced downwardly by a suitable air cylinder 58 and is moved upwardly by the action of the spring 56.

On each side of the central tightening roller 40 are free-floating rollers 48 and 50. The idle rollers 48 and 50 are for keeping the collar material in a plane with the plates 30A and 30B, and the central roller moves the collar material or liner upwardly between the two idle rollers to draw the ends of the collar or liner material tautly against the outer edge of the plates 30A and 30B.

The stays 14 are fed into the machine by providing a magazine 60 in which the stays are stacked. Slideable beneath the stack is a plate 62 which is timely operated by an air cylinder 64. The plate 62 is provided with a recessed face of such depth as to receive a single stay as shown at 66 in FIG. 4. The plate 62 engages a single stay and moves it to a channel formed in the member 68. Operating within the channel member 68 is a semi-rigid band 70 which is movable along and within the channel 68 for moving the stay from the point at which it is deposited by the member 62 to the position within the pocket of the collar or liner where it is attached to the collar element, after which the band 70 is retracted by the operation of a switch 72 and a pin 71 controlling the air cylinder 74 to cause a return of the band to its starting position. The screw 73 limits the movement of the semi-rigid band 70 through the channel 68 to control the final position of the stay within the collar member.

Figures 1, 4, 5, 6, 7, 8:
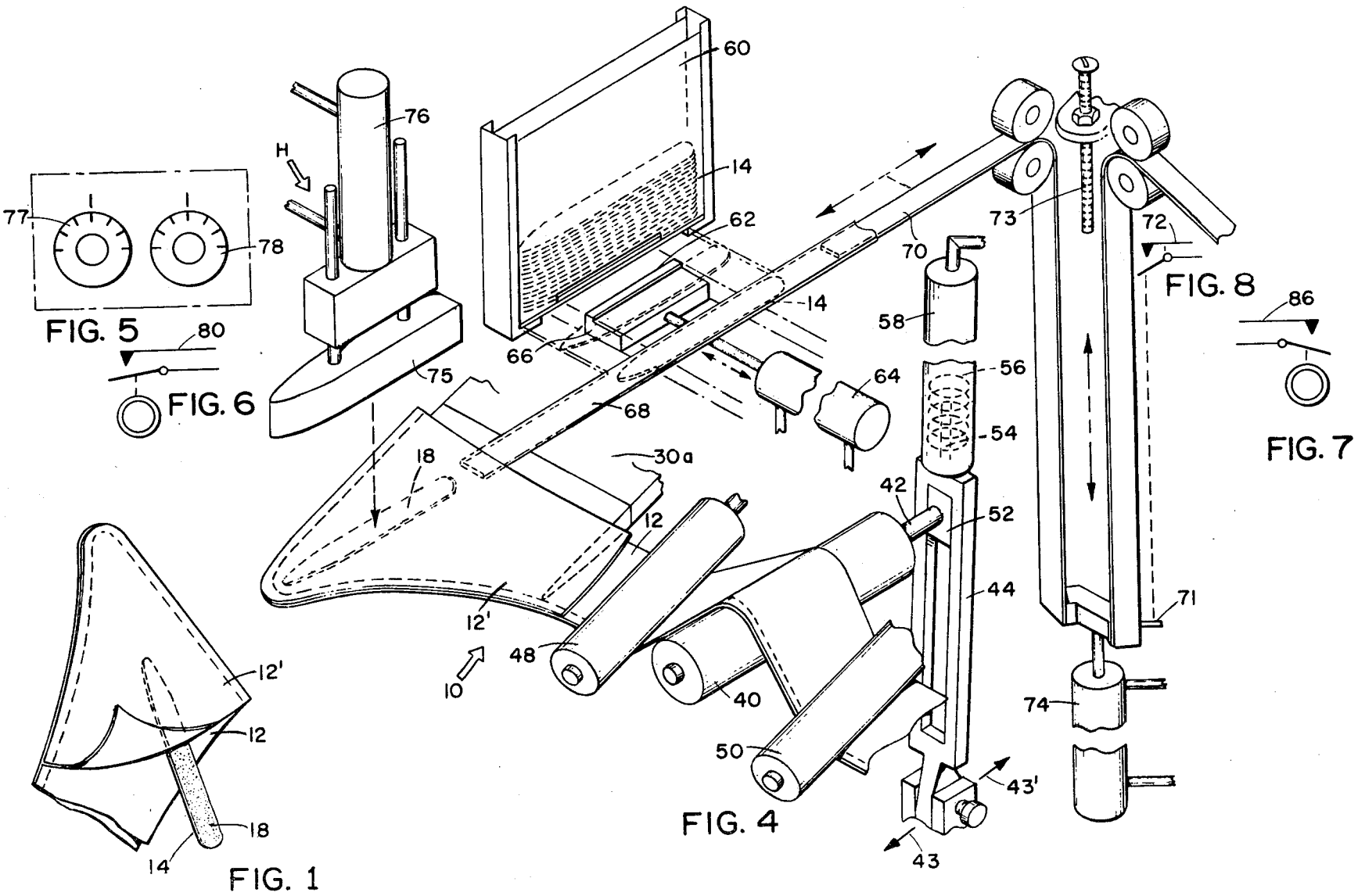
FIG. 1 is a fragmentary perspective view of a portion of a shirt collar showing a stay being inserted within a collar unit.
FIG. 4 is a perspective detail view of one side of the apparatus illustrating more in detail the operation of the machine.
FIG. 5 is a diagramatical view of a temperature and timing switch for the heating means.
FIG. 6 is a diagramatical view of an electrically operated switch for operating a means for carrying out the first phase of the operation of the machine.
FIG. 7 is a diagramatical view of an electrically operated switch for setting in motion the second phase of the operation for actually applying the stays to the collar element.
FIG. 8 is a diagramatical view of an electrically operated switch for releasing the motion of the feeding mechanism.

The stay is attached to the collar material by a heating unit carried in an assembly as shown at H in FIG. 4. The unit as shown at H is fixedly positioned over the area where the band 70 deposited the stay. The element 75 containing the heating unit is lowered to the area of the stay by a timed operated air cylinder 76, and through appropriate electrical wiring, heat is applied and the adhesive film is softened and the stay is fixed to the collar or liner as the case may be.

In FIG. 5 is shown a diagramatical view of a switch 77 for controlling the temperature of the two heating units, and at 78 is shown a timing gauge for registering the period the heating element is in operation.

Since the machine is duplicated for the same operation on the other end of the collar or liner, it is not deemed necessary to repeat the detailed description of the machine or its operation. Instead of repeating the reference numerals for the duplicated side of the machine, the same numbers are used and are identified as prime numbers.

To begin the operation, a collar or liner is placed over the ends of the plates 30A and 30B, and is normally of double thickness which allows the stays to be inserted between the two layers of material. To start the operation, the button 80 is depressed which will cause the tightening roller 40 to move upwardly drawing the ends of the collar, or liner material, tightly against the said plates 30A and 30B. The machine will not operate further until a second button 86 is depressed. This gives time for making any adjustments of the collar or liner before the stays are actually attached thereto. By depressing the button 86, the final phase of the operation of the machine will begin and carry through until the stays are fixed into the collar assembly as previously described after which the machine will automatically return to its starting position, when the collar element with the attached stiffening stay may be removed.

The operations are all electrically controlled through electric controlled air cylinders as previously referred to. Any number of control elements may be installed to effect the proper operation of the apparatus, such as, the moving of the various elements in timed relationship. For example, switch 80 operates only the tightening roll 40, and the switch 86 is for starting the operation of a complete cycle of attaching the stays to the collar element. The apparatus as stated is substantially automatic throughout except for the starting and stopping and placing of the stays within the magazines.

The method of attaching stays to the collar or collar linings is not intended as a limitation as the scope of the invention is best defined in the following claims.

I claim:

1. A method of automatically attaching stiffening stays to outer end portions of collar members comprising the steps:

(a) forming a plurality of elongated stiffening stays and coating at least one side of the stiffening stays with heat sensitive adhesive;

(b) stacking the stiffening stays one upon the other in a magazine;

(c) removing the stiffening stays from the underside of the stack into a channel;

(d) providing a pair of planar members fixedly spaced apart;

(e) inserting a said planar member into each outer end portion of a collar member;

(f) drawing the collar member outer end portions at the same time tightly in-plane with said planar members by drawing the collar member outer end portions toward the center of the collar member;

(g) moving a stiffening stay along the channel to a predetermined area within an outer end portion of the collar member; and (h) heating the stiffening stay until the heat sensitive adhesive softens and adheres to the collar member thereby attaching a stiffening stay to the outer end portion of a collar member.

2. A method of attaching stiffening stays to the end portions of collar members comprising the steps:

(a) forming a plurality of stiffening stays of flexible polyester plastic;

(b) coating at least one side of each stiffening stay with a polyester fusible film having capacity when in a softened state to bind the stiffening stay to a collar member;

(c) attaching respective end portions of a collar member to respective spaced-apart plate members;

(d) tightening the end portions of the collar member on said spaced-apart plate members at the same time by drawing the center of the collar member;

(e) applying at the same time a respective stiffening stay to each end portion of the collar member; and (f) heating and softening at the same time the polyester fusible film on each applied stiffening stay; thereby attaching stiffening stays to the end portions of the collar member.

3. A method of attaching stiffening stays to the outer ends of a collar member comprising the steps:

(a) forming a plurality of stiffening stays;

(b) coating at least one side of each stiffening stay with a heat sensitive adhesive;

(c) inserting a respective one of spaced apart plate members into each outer end of the collar member;

(d) tightening the outer ends of the collar member on said plate members at the same time by drawing intermediate portions of the collar member in opposite directions;

(e) applying at the same time a stiffening stay to each outer end of the collar member; and (f) heating the stiffening stays and causing the heat sensitive adhesive to adhere to the collar member; thereby attaching stiffening stays to the outer ends of the collar member.

* * * * *